US005319163A

United States Patent [19]

Scott

[11] Patent Number: 5,319,163

[45] Date of Patent: * Jun. 7, 1994

[54] WATERPROOF EARMOLD-TO-EARPHONE ADAPTER

[76] Inventor: Robert T. Scott, 416 Lighthouse Ave., Santa Cruz, Calif. 95060

[ * ] Notice: The portion of the term of this patent subsequent to Nov. 7, 2006 has been disclaimed.

[21] Appl. No.: 969,381

[22] Filed: Oct. 30, 1992

Related U.S. Application Data

[63] Continuation-in-part of Ser. No. 535,012, Jun. 7, 1990, abandoned, and a continuation-in-part of Ser. No. 656,009, Feb. 15, 1991, abandoned.

[51] Int. Cl.[5] ..... H04R 25/02

[52] U.S. Cl. ..... 181/130; 181/135; 381/68.6; 381/69

[58] Field of Search ..... 181/129, 130, 135; 128/864, 865, 866, 867, 868; 381/68.6, 69, 69.2, 169, 187, 188, 205

[56] References Cited

U.S. PATENT DOCUMENTS

| | | | |
|---|---|---|---|
| 2,584,402 | 2/1952 | Volkmann | 181/129 |
| 3,415,246 | 12/1968 | Hill | 181/130 |
| 3,565,069 | 2/1971 | Miller | 128/867 |
| 4,878,560 | 11/1989 | Scott | 181/130 |

*Primary Examiner*—Michael L. Gellner
*Assistant Examiner*—Eddie C. Lee

[57] ABSTRACT

A waterproof earmold-to-earphone adapter is provided for use in conjunction with an earmold. The earmold has a passageway extending transversely therethrough to allow sound to pass through the earmold, and the adapter has a hollow, elongated stem which slides into and frictionally engages the passageway in the earmold. The adapter has a resilient, cylindrical holder carried by the stem, the holder being adapted to receive a waterproof earphone whereby sound from the earphone passes through the hollow stem directly into the user's auditory canal. The passageway of the hollow stem is of small enough diameter and great enough length to prevent water passing through, but allows air and sound to pass through.

16 Claims, 1 Drawing Sheet

WATERPROOF EARMOLD-TO-EARPHONE ADAPTER

CROSS REFERENCE TO RELATED APPLICATION

This application is a continuation-in-part of U.S. application Ser. No. 07/535,012, filed Jun. 7, 1990, now abandoned, and of U.S. application Ser. No. 07/656,009, filed Feb. 15, 1991 now abandoned.

BRIEF SUMMARY OF THE INVENTION

The present invention relates generally to an earmold adapter capable of supporting an earphone. More particularly, the present invention represents a waterproof earmold adapter and support for an earphone and the like which may be used while swimming.

A primary object of the invention is to provide a waterproof apparatus which supports an earphone and transmits sound into the user's external ear canal.

A further object of the invention is to provide a waterproof earphone support which is floatable, and which may be used when swimming together with floatable electronic devices.

A further object of the invention is to provide a waterproof means of securing an earphone to a preformed earmold of various sizes.

A further object of the invention is to provide a waterproof adapter for use with an earmold which may be used in conjunction with an assistive listening device for users with hearing impairment.

A further object of the invention is to provide a waterproof adapter for use with an earmold which facilitates the use of FM and infrared communicators as well as modular hearing aids.

Various other objects and features of the invention will be brought out in the balance of the application.

DETAILED DESCRIPTION OF THE PREFERRED EMBODIMENT

Figure 1:
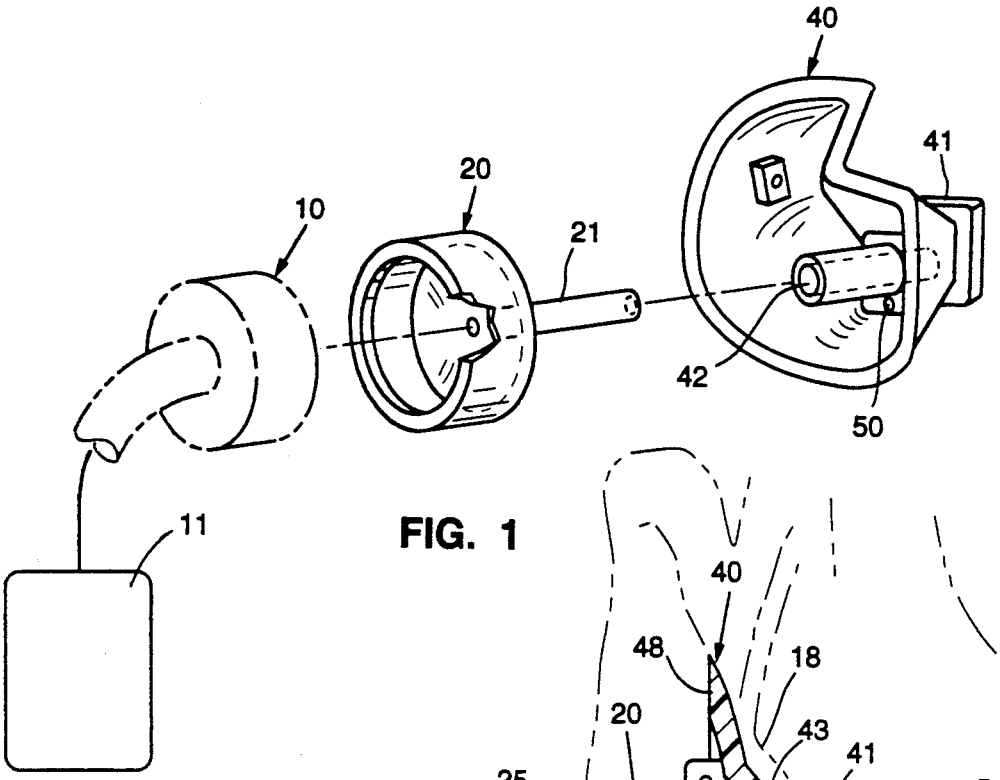
FIG. 1 is an exploded view in perspective showing an earphone, the adapter according to the present invention and an earmold.

As shown best in FIG. 1, the adapter is shown generally as 20. The adapter 20 is intended to be inserted into a preformed earmold shown generally as 40. Earmold 40 as shown in FIG. 1 is constructed in accordance with my U.S. Pat. No. 4,878,560. A waterproof earphone 10 shown in phantom is connected to a waterproof cassette tape player or radio 11.

Figure 2:
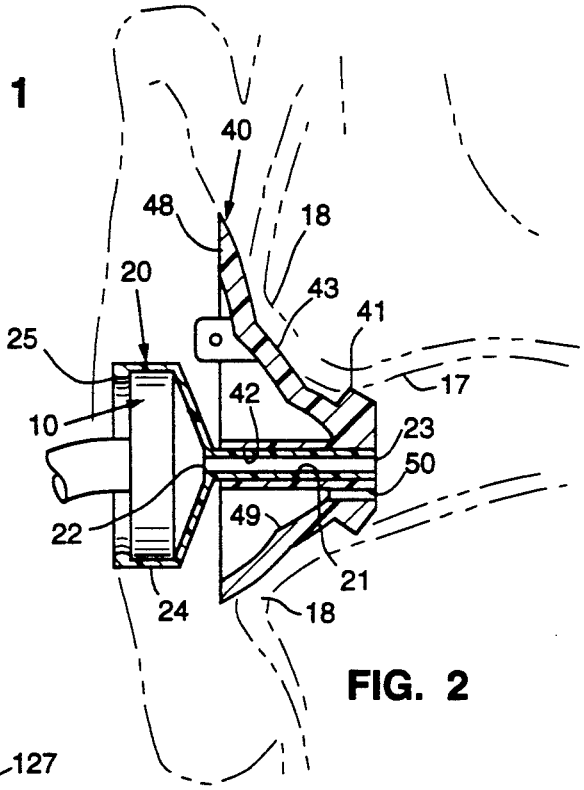
FIG. 2 is a sectional view showing the adapter of the present invention in combination with an earmold in place in the ear of a user.

As shown best in FIG. 2, the earmold 40 is an integrally formed, ready-to-wear earmold made of a soft, flexible plastic of durometer hardness of 50 or less, and having thin walls 48,49 and having an inwardly extending conical portion 43 adapted to fit into a cavum concha 18 and outer portion of an auditory or external ear canal 17, terminating in a knob 41. Knob 41 seals off the meatus of said external ear canal without substantially penetrating said canal. A cylindrical passageway 42 extends laterally outwardly from knob 41 through earmold 40 to allow sound to pass through said earmold directly into the user's auditory canal 17.

The earmold-to-earphone adapter 20 has a hollow, elongated stem 21 having an input end 22 adjacent earphone 10 and an output end 23 which extends into the user's auditory canal 17 when adapter 20 is in its mounted position shown in FIG. 2. Stem 21 is carried by earmold 40 by sliding into and frictionally engaging passageway 42 formed in earmold 40. Stem 21 has an internal passageway 29 having a diameter and length to prevent water from passing through internal passageway 29. By having a diameter of between 0.020 and 0.065 inch and a length of between 0.500 and 0.600 inch, I have found that surface tension prevents water penetration, but air is allowed to pass with sound vibrations.

A resilient, cylindrical holder 24 is carried by stem 21. Holder 24 is adapted to receive a waterproof earphone 10 as, for example, by having a diameter slightly less than the diameter of earphone 10 and by having a retaining lip 25 extending around its circumference to help retain earphone 10 in its mounted position shown in FIG. 2.

As shown in FIG. 2, the weight of earphone 10 is transferred through stem 21 to earmold 40. In those instances in which the user is subjected to conditions of weightlessness or being upside down for periods of time, the earmold is held to the user's ear by having a radius of curvature of conical portion 43 of earmold 40 somewhat greater than the radius of curvature of the user's cavum concha 18.

A vent passage 50 is formed in earmold 40 to allow equalization of pressures underwater with no interference with waterproofness of the earmold to earphone adapter. The diameter of vent passage 50 is 0.050 inches.

The adapter 20 is preferably made of a material less dense than water, such as polyvinyl chloride, Kraton or low density plastic. The adapter is preferably made of soft material having a durometer softness of about 65.

Figure 3:
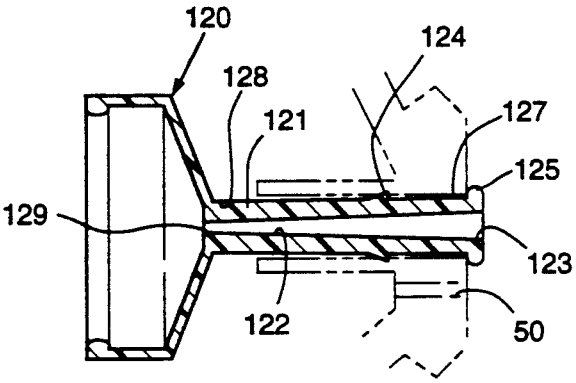
FIG. 3 is a sectional view of an alternate embodiment of the invention.

An alternate form of the invention is shown as adapter 120 in FIG. 3. In this alternate form, the hollow, elongated stem portion 121 forms a horn shaped passageway 122 therein, with the diameter of passageway 122 increasing from the input end 129 to the output end 123 of passageway 122. When the output diameter of passageway 122 exceeds the input diameter 129 by at least factor of 2, the amplification in the higher frequencies of sound is increased, which is of particular benefit to those hearing impaired users.

As shown in FIG. 3, stem 121 has a constant outer diameter, and has a greater wall thickness 128 near input end 129, as compared to the wall thickness 127 near output end 123. Alternatively, the wall thickness of stem 121 may be uniform, in which case the outer diameter of stem 121 increases from the input end 128 to the output 127. A lip 125 may be used at the output end of stem 121, extending circumferentially around output end 127 to help retain adapter 120 in its mounted position shown in FIG. 3. Additionally, a small barb 124 may be included on the surface of stem 121 to help retain adapter 120 in its mounted position shown in FIG. 3. The adapter shown in FIG. 3 is made of a harder polyvinyl chloride having a shore hardness of about 85.

What is claimed is:

1. A waterproof earmold-to-earphone adapter for supporting an earphone from the ear of a user, without requiring the use of a headband, which apparatus may be used underwater, comprising:

an earmold including a body sealably insertable into the ear of a user to seal off the external ear canal without substantially penetrating into the external ear canal, an a tubular projection projecting from said body in a direction outwardly of the ear of the user, said earmold having a passageway extending through said projection and opening into the external ear canal of the user, an earmold-to-earphone adapter having a hollow, elongated stem which is slidable into said tubular projection on the earmold for frictional engagement in said passageway in said earmold, wherein said stem extends in and through said tubular projection to open directly into said external ear canal, and wherein said stem has an end projecting beyond the passageway in said tubular projection into said external ear canal and includes retaining means on said end for engaging said body of said earmold to retain said stem in said tubular projection, said elongated stem having an internal passageway therein in direct communication with said external ear canal for transmitting sound from outside said adapter to the external ear canal, said internal passageway in said stem being dimensioned to transmit said sound therethrough while preventing passage of water due to the surface tension of the water, the diameter of said internal passageway being between 0.020 and 0.065 inch and the length of said internal passageway being between 0.500 and 0.600 inch, whereby said dimensions of said internal passageway prevent water from passing therethrough but allow sound to pass therethrough, and a resilient holder carried by said stem, said holder being adapted to receive an earphone.

2. The apparatus of claim 1 wherein said earmold and adapter are made of material having a density less than the density of water.

3. The apparatus of claim 1, wherein said earmold and said adapter are made of a material having a density less than the density of water, said adapter having a hardness greater than the hardness of the earmold.

4. The apparatus of claim 1, wherein said holder comprises a hollow socket having an outer annular wall, said earphone being insertable in said socket, and a retaining lip on said annular wall to engage a back surface of the earphone to retain the earphone in said socket.

5. The apparatus of claim 4, wherein said lip is annular.

6. The apparatus of claim 5, wherein said annular wall is cylindrical.

7. The apparatus of claim 6, wherein said holder further comprises a conical wall connecting said stem and said cylindrical wall.

8. The apparatus of claim 7, wherein said passageway in the tubular projection of the earmold is cylindrical and said stem extends cylindrically from said conical wall to a free end of the stem at which the internal passageway opens into and is in direct communication with the external ear canal of the user.

9. The apparatus of claim 1, wherein said passageway in said stem is constructed to provide sound amplification from the earphone into the ear canal.

10. The apparatus of claim 9, wherein said passageway in said stem has a diameter which increases towards the ear canal to amplify the sound.

11. The combination comprising an integrally formed earmold having thin walls and having an inwardly extending conical portion adapted to fit into a concha and outer portion of an auditory canal, terminating in a rectangular knob with a small flange thereon, said knob sealing off a meatus of an external ear canal without substantially penetrating the external canal, said flange anchoring the earmold at the entrance of the external ear canal, and a hollow cylinder, with a passageway, extending laterally from said knob a sufficient distance to form a support, said integrally formed earmold being made of a soft, flexible, elastic plastic, and a waterproof earmold-to-earphone adapter for supporting an earphone from the earmold, without requiring the use of a headband, and which enables the combination to be used underwater, said earmold-to-earphone adapter comprising a hollow, elongated stem which slides into the frictionally engages said passageway in said cylinder of said earmold, said elongated stem having an internal passageway with a diameter between 0.020 and 0.065 inch and a length between 0.500 and 0.600 inch, whereby the dimensions of said internal passageway prevent water from passing therethrough but allow sound to pass therethrough, and a resilient holder carried by said stem, said holder being adapted to receive an earphone.

12. The combination as claimed in claim 11, wherein said earmold and adapter are each made of material having a density less than the density of water.

13. The combination as claimed in claim 12, wherein the material of the adapter has a hardness greater than the hardness of the material of the earmold.

14. The combination as claimed in claim 11, wherein said stem extends in and through said hollow cylinder to open directly into said external ear canal.

15. The combination as claimed in claim 11, wherein said holder comprises a hollow socket having a conical wall connected to said stem.

16. The combination as claimed in claim 11, wherein said passageway in the hollow cylinder of the earmold is cylindrical and said stem is cylindrical and has a free end at which the internal passageway opens directly into the external ear canal.

* * * * *